US005787906A

United States Patent [19]

D'Andrea

[11] Patent Number: 5,787,906

[45] Date of Patent: Aug. 4, 1998

[54] DEFORMABLE PUSH-BUTTON RELEASE FOR COSMETIC COMPACTS

[75] Inventor: Daren Mark D'Andrea, Stamford, Conn.

[73] Assignee: Nadel Industries, Inc., Port Chester, N.Y.

[21] Appl. No.: 994,612

[22] Filed: Dec. 19, 1997

[51] Int. Cl.[6] ..... A45D 42/02

[52] U.S. Cl. ..... 132/293; 132/301

[58] Field of Search ..... 132/293, 290, 132/296, 301; 220/281, 323

[56] References Cited

U.S. PATENT DOCUMENTS

| | | | |
|---|---|---|---|
| 4,392,503 | 7/1983 | Watanabe | 132/301 |
| 4,679,576 | 7/1987 | Yuhara et al. | 132/293 |
| 4,774,973 | 10/1988 | Gueret | 132/293 |
| 4,799,503 | 1/1989 | Tahara | 220/260 |
| 4,834,122 | 5/1989 | Yuhara et al. | 132/293 |
| 4,930,528 | 6/1990 | Hatakeyama | 132/293 |
| 4,972,860 | 11/1990 | Yuhara et al. | 132/293 |
| 4,989,622 | 2/1991 | Kozuka et al. | 132/293 |
| 5,050,623 | 9/1991 | Yuhara et al. | 132/301 |
| 5,232,001 | 8/1993 | Michelett | 132/293 |
| 5,276,893 | 1/1994 | Enomoto et al. | 132/301 |
| 5,295,496 | 3/1994 | Machelett | 132/293 |
| 5,682,910 | 11/1997 | Kizawa et al. | 132/293 |

FOREIGN PATENT DOCUMENTS

| | | | |
|---|---|---|---|
| 567376 | 10/1993 | European Pat. Off. | 132/293 |

*Primary Examiner*—Paul J. Hirsch

*Attorney, Agent, or Firm*—Amster, Rothstein & Ebenstein

[57] ABSTRACT

A cosmetics compact container having a deformable push-button release, comprising: a top-section having a first end and a second end, a bottom-section having a first end and a second end, the top-section and the bottom-section being hingedly connected at one of the first and second ends thereof and collectively defining a cosmetics receptacle therein, the top-section and the bottom-section adapted to pivot relative to each other between an open configuration and a closed configuration; a latch for engaging the top-section and the bottom-section and for maintaining the top-section and the bottom-section in the closed configuration; and a deformable push-button release operably associated with one of the top-section and the bottom-section for disengaging the top-section from the bottom-section when in the closed configuration, the deformable push-button release comprising a finger-pressure deformable material for generating a spreading force when pressure is applied to the deformable push-button release by a user to pivot the top-section relative to the bottom-section to thereby disengage the top-section from the bottom-section.

6 Claims, 3 Drawing Sheets

DEFORMABLE PUSH-BUTTON RELEASE FOR COSMETIC COMPACTS

BACKGROUND

The present invention relates generally to a release arrangement for hingedly connected container components, and more particularly, to a deformable material push-button release for cosmetic compacts.

Typical prior art compact cosmetic cases have a generally pan-like case body and a substantially flat cover that is hingedly connected to one end of the body. The case body customarily contains a receptacle for storing cosmetics, and the cover typically includes a mirror disposed on an inner face thereof to aid in applying makeup. Such compacts ordinarily have a latching assembly that maintains the compact in a closed orientation for carrying makeup, and a release mechanism for disengaging the cover from the body. Unfortunately, most prior art release mechanisms are needlessly complex, resulting in higher fabrication costs, and diminished reliability and durability.

A representative prior art cosmetic compact is disclosed in U.S. Pat. No. 4,679,576 to Yuhara et al. ("Yuhara"). The Yuhara reference teaches a conventional compact having interengaging first and second latch tongues and an associated release member. The release member includes a tilt arm that is hingedly connected to the vertical front wall of the release member and disposed to engage a projection on the cover member. To release the cover from the body, the user presses the release member to cause the tilt arm to pivot and disengage the latch tongues so that the cover may then be freely pivoted relative to the body.

Further examples of prior art compacts with similar release mechanisms may be found in U.S. Pat. Nos. 4,834,122 to Yuhara et al., 4,989,622 to Kozuka et al., and 4,799,503 to Tahara.

Yet another prior art compact release mechanism is shown in U.S. Pat. No. 4,774,973 to Gueret ("Gueret"). The Gueret compact includes a base, lid and release mechanism which comprises a V-shaped element, one side of which constitutes a manipulating push-button projecting from the casing of the compact when in a closed configuration and the other, relatively flexible side of which constitutes a catch-engagement arm having a free end oppositely disposed to the push-button and shaped as a catch-engagement bead that cooperates with a catch constituting a fixed component associated with the closing device. To open the lid, the manipulating push-button is depressed to cause the catch-engagement arm to bear on a suitably disposed bearing surface of the base so that the catch-engagement arm emerges from the catch of the lid, thereby enabling the lid to be pivotally displaced relative to the base.

All of the above-identified prior art compact release arrangements suffer from the same fundamental drawback. In particular, they are relatively complicated in construction, and consequently, manufacturing costs are high while durability and ease of use are reduced. Therefore, a need exists in the art for a new compact release that facilitates ease of fabrication, improved durability and utility, in a simple structure that avoids the complications found in the prior art.

SUMMARY OF THE INVENTION

In accordance with the foregoing, it is an object of the present invention to provide a deformable push-button release for a cosmetics compact that is simplistic in design, yet functionally superior to those found in the prior art.

It is a further object of the present invention to provide a deformable push-button release for a cosmetics compact that facilitates ease of manufacture by minimizing the number of constituent parts thereof.

It is yet another object of the present invention to provide a deformable push-button release for a cosmetics compact that can durably withstand repeated use over a longer life cycle.

In accordance with the above objects and additional objects that will become apparent hereinafter, the present invention provides a cosmetics compact having a deformable push-button release. The compact comprises a lid or top-section having a first end and a second end; a body or bottom-section having a first end and a second end, where the top-section and the bottom-section are hingedly connected at one end thereof. The top-section and the base collectively define a cosmetics container therein, and are adapted to pivot relative to each other between an open configuration and a closed configuration. A latching assembly is disposed at one end of the top-section and the bottom-section opposite from the hinged connection for engaging and maintaining the top-section and the bottom-section in the closed configuration. The compact further includes a deformable push-button release operably associated with either the top-section or the bottom-section for disengaging the top-section from the bottom-section when latched in the closed configuration. The deformable push-button release consists of a finger-pressure deformable material, disposed relative to the top-section and the bottom section such that a spreading force is generated when finger pressure is applied thereto by a user, to pivotally separate the top-section from the bottom-section at the common ends thereof. In the preferred embodiment, the top-section is defined by an outer face and an opposed inner face, and includes a recessed pressure distribution wall extending generally perpendicular to the outer face and a top wall at one end thereof. The pressure distribution wall forms part of a recessed area defined by a top wall and the pressure distribution face in the top-section and a bottom wall defined in the bottom-section. The deformable push-button release consists of an elastomeric material disposed in the recessed area and attached to a portion of the top-section or the bottom-section. When finger pressure is applied to the elastomeric material, it deforms against the pressure distribution wall and spreads in at least one of a vertical direction and a horizontal direction relative to the pressure distribution wall to cause a portion of the elastomeric material to exert a force that separates the top-section from the bottom-section about the hinged connection therebetween.

The present invention will be better understood and the advantages thereof appreciated as the detailed description proceeds below with particular reference to the accompanying drawings.

DETAILED DESCRIPTION OF THE PREFERRED EMBODIMENT

Figure 1:
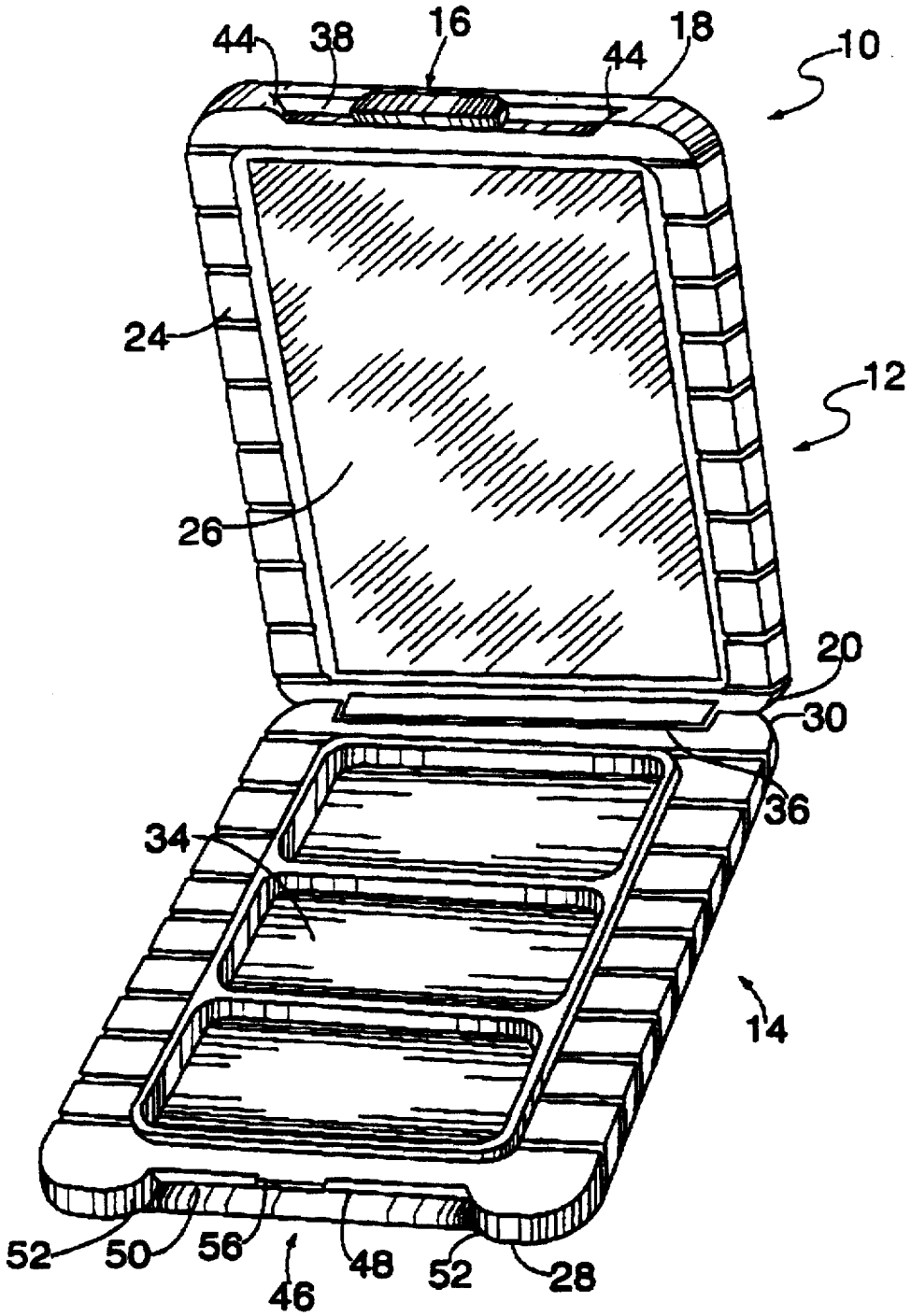
FIG. 1 is an isometric view of a cosmetics compact in accordance with the present invention.
Figure 2:
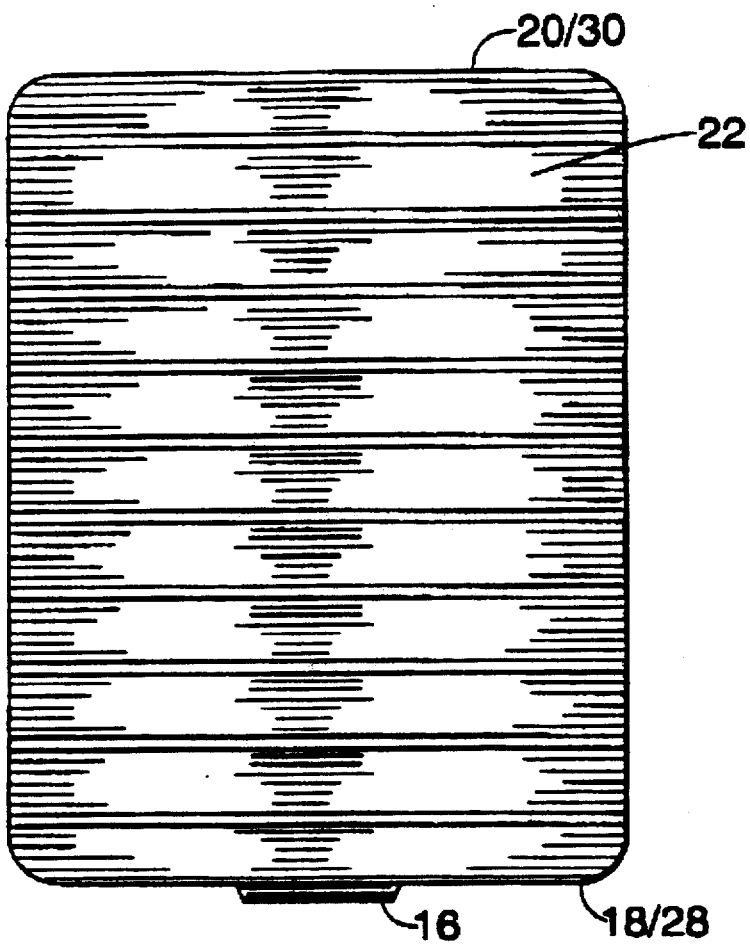
FIG. 2 is a top plan view thereof.
Figure 3:
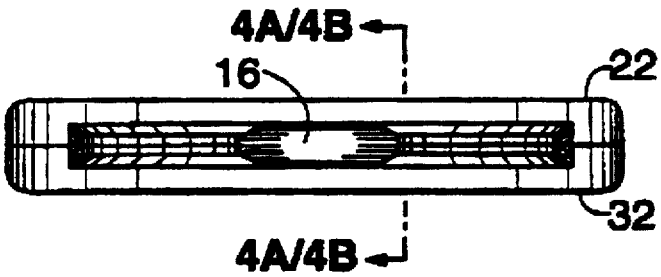
FIG. 3 is a front elevational view thereof.

With reference to the several views of the drawings, there is depicted a cosmetics compact generally denoted by the reference numeral 10, comprising a lid or top-section 12, a body or bottom section 14, and a deformable push-button release member 16. The top-section 12 and the bottom-section 14 are fabricated by injection molding a suitable plastic material as is well known in the art. The top-section 12 generally includes a first end 18, a second end 20, an outer surface 22 and an inner face 24. In the illustrative embodiment, the inner surface 22 is molded with a depressed region for mounting a mirror 26.

The bottom-section 14 generally includes a first end 28, a second end 30, an outer surface 32, and a plurality of integral wells 34 for storing cosmetics. The top-section 12 and bottom-section 14 are pivotally joined at a hinge denoted by the reference numeral 36, and are free to move relative to each other between a closed configuration (FIGS. 2–4A) and an open configuration (FIGS. 1 and 4B).

Figure 4A:
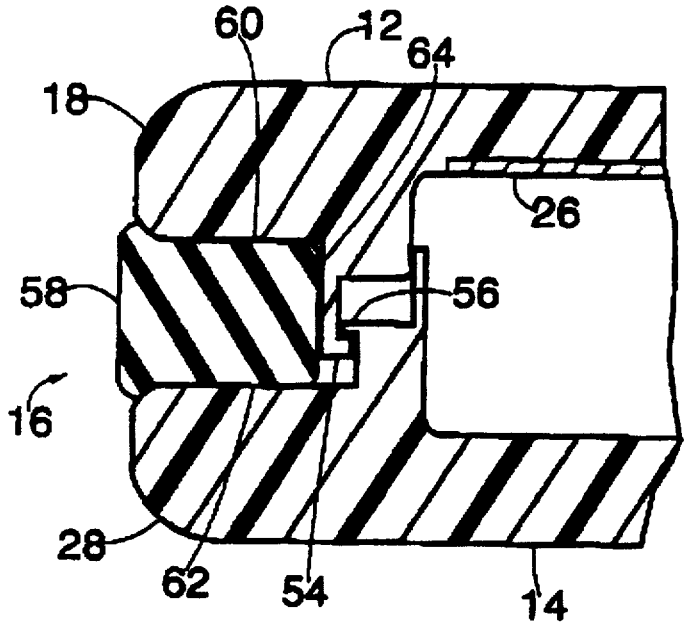
FIG. 4A is partial sectional view along lines 4A—4A in FIG. 3 depicting the cosmetics compact in a closed or latched configuration and details of the deformable push-button release.
Figure 4B:
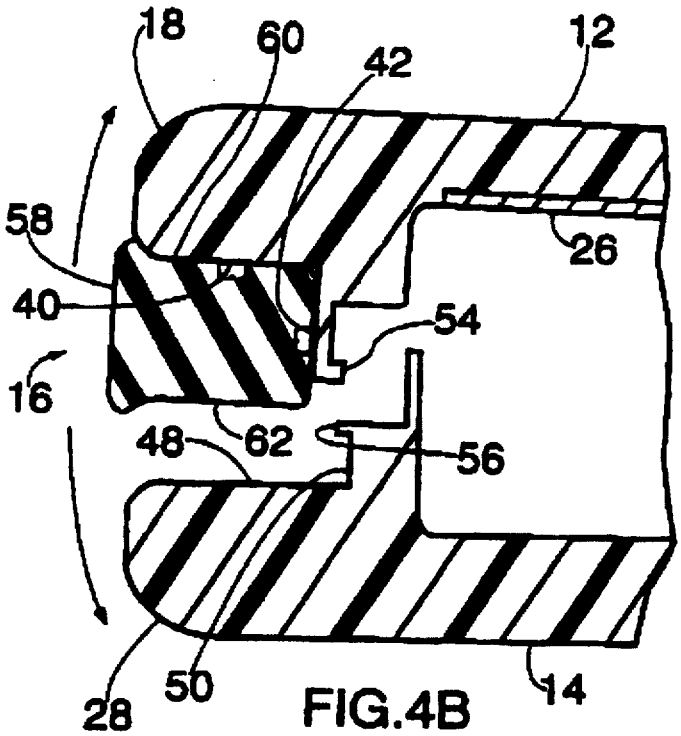
FIG. 4B is a partial sectional view thereof along lines 4B—4B with the cosmetics compact in a partially open configuration.

Referring now to FIGS. 4A and 4B, the top-section 12 includes an integral recessed area 38 defined by a top wall 40, a recessed pressure distribution wall 42, and a pair of opposed side walls 44. The bottom-section 14 includes a corresponding integral recessed area 46 defined by a bottom wall 48, a recessed vertical wall 50, and a pair of opposed side walls 52. A clasp or latch is formed by a tongue 54 formed in the pressure distribution wall 42 of the top-section 12, which interengages a lip 56 integral with the vertical wall 50 of the bottom-section 14 to maintain the compact 10 in the closed configuration as shown in FIG. 4B.

The push-button release member 16 is disposed in, and attached to the top-section of the recessed area 38 as shown. However, the depicted arrangement is intended to be exemplary; the push-button release member 16 may be situated within the recessed area 46 of the bottom-section instead. In addition, the push-button release member 16 may be disposed along the sides of the top-section and bottom-section (not shown) in lieu of the ends as shown. As depicted in FIGS. 4A and 4B, the push-button release member 16 is defined by a front surface 58, top surface 60, bottom surface 62, and rear surface 64, and is attached to the top wall 40 and the recessed pressure distribution wall 42 by any suitable means, for example by bonding the components together with an adhesive. The push-button release member 16 consists of an elastomeric material that is easily deformable under finger pressure. The push-button release member enables the compact to be easily opened from the closed orientation (FIGS. 2–4B) to the open configuration (FIGS. 1 and 4A) by simply applying finger pressure in a direction substantially in alignment with the longitudinal extent of the respective outer surfaces 22, 32 of the top-section 12 and bottom section 14. In this regard, when finger pressure is applied to the front surface 58 of the push-bottom release 16, an upward and downward spreading force is generated as a result of the opposing reaction with the pressure distribution wall 42, thereby pushing the first end 18 of the top-section 12 away from the first end 28 of the bottom-section 14 and pivotally rotating the top-section 12 relative to the bottom-section 14 to the open configuration. To return to the closed or latched configuration, the user simply presses the first end 18 of top-section 12 against the first end 28 of the bottom-section 14 to cause the tongue 54 to overlap and engages the lip 56 as shown.

Although the deformable push-button release in accordance with the present invention has been shown and described with respect to a cosmetic compact, it is anticipated that such an arrangement may be equally adapted to other applications where the quick release of two pivotally or hingedly connected members is desired, and that obvious modifications of the depicted illustrative embodiments will be implemented by persons skilled in the art.

I claim:

1. A cosmetics container having a deformable push-button release, comprising:

a top-section having a first end and a second end;

a bottom-section having a first end and a second end, said top-section and said bottom-section being hingedly connected at one of said first and second ends thereof and collectively defining a cosmetics receptacle therein, said top-section and said bottom-section adapted to pivot relative to each other between an open configuration and a closed configuration;

latching means for engaging said top-section and said bottom-section and for maintaining said top-section and said bottom-section in said closed configuration; and a deformable push-button release operably associated with one of said top-section and said bottom-section for disengaging said top-section from said bottom-section when in said closed configuration, said deformable push-button release comprising a finger-pressure deformable material for generating a spreading force within said material when pressure is applied to said deformable push-button release by a user to separate and pivot said top-section relative to said bottom-section to thereby disengage said top-section from said bottom-section.

2. The cosmetics compact container recited in claim 1, wherein said deformable push-button release comprises an elastomeric material.

3. The cosmetics compact container recited in claim 1, wherein said latch means comprises a first clasping member associated with said top-section engagable with a second clasping member associated with said bottom-section to maintain said top-section and said bottom-section in said closed configuration.

4. The cosmetics compact container recited in claim 1, wherein said top-section is defined by an outer face and an opposed inner face, said top-section member including a recessed pressure distribution wall extending generally perpendicular to said outer face and a top wall at one of said first and second ends thereof, said pressure distribution wall forming part of a recessed area defined by said top wall and said pressure distribution wall in said top-section and a bottom wall defined in said bottom-section, said deformable push-button release comprising an elastomeric material disposed in said recessed area such that when finger pressure is applied to said elastomeric material, said elastomeric material deforms against said pressure distribution wall and spreads in at least one of a vertical direction and a horizontal direction relative to said pressure distribution wall to cause a portion of said elastomeric material to disengage said latch means and push said top-section and said bottom-section apart about said hinged connection therebetween.

5. A cosmetics compact container having a deformable push-button release, comprising:

a top-section having a first end and a second end;

a bottom-section having a first end and a second end, said top-section and said bottom-section being hingedly connected at one of said first and second ends thereof and collectively defining a cosmetics receptacle therein, said top-section and said bottom-section adapted to pivot relative to each other between an open configuration and a closed configuration;

latching means for engaging said top-section and said bottom-section and for maintaining said top-section and said bottom-section in said closed configuration; and a deformable push-button release operably associated with one of said top section and said bottom-section for disengaging said top-section from said bottom-section when in said closed configuration, said deformable push-button release comprising a finger-pressure deformable material for generating a spreading force when pressure is applied to said deformable push-button release by a user to pivot said top-section relative to said bottom-section to thereby disengage said top-section from said bottom-section, said top-section being defined by an outer face and an opposed inner face, said top-section including a recessed pressure distribution wall extending generally perpendicular to said outer face and a top wall at one of said first and second ends thereof, said pressure distribution wall forming part of a recessed area defined by said top wall and said pressure distribution wall in said top-section and a bottom wall defined in said bottom-section, said deformable push-button release comprising an elastomeric material disposed in said recessed area such that when finger pressure is applied to said elastomeric material, said elastomeric material deforms against said pressure distribution wall and spreads in at least one of a vertical direction and a horizontal direction relative to said pressure distribution wall to cause a portion of said elastomeric material to push said top-section and said bottom-section apart about said hinged connection therebetween.

6. A container having a deformable push-button release, comprising:

a top-section having a first end and a second end;

a bottom-section having a first end and a second end, said top-section and said bottom-section being hingedly connected at one of said first and second ends thereof, said top-section and said bottom-section adapted to pivot relative to each other between an open configuration and a closed configuration;

latching means for engaging said top-section and said bottom-section and for maintaining said top-section and said bottom-section in said closed configuration; and a deformable push-button release operably associated with one of said top-section and said bottom-section for disengaging said top-section from said bottom-section when in said closed configuration, said deformable push-button release comprising a finger-pressure deformable material for generating a spreading force when pressure is applied to said deformable push-button release by a user to pivot said top-section relative to said bottom-section to thereby disengage said top-section from said bottom-section, said top-section being defined by an outer face and an opposed inner face, said top-section including a recessed pressure distribution wall extending generally perpendicular to said outer face and a top wall at one of said first and second ends thereof, said pressure distribution face forming part of a recessed portion defined by said top wall and said pressure distribution face in said top-section and a bottom wall defined in said bottom-section, said deformable push-button release comprising an elastomeric material disposed in said recessed portion such that when finger pressure is applied to said elastomeric material, said elastomeric material deforms against said pressure distribution wall and spreads in at least one of a vertical direction and a horizontal direction relative to said pressure distribution wall to cause a portion of said elastomeric material to push said top-section and said bottom-section apart about said hinged connection therebetween.

* * * * *